United States Patent [19]

Dilbey

[11] 4,000,344

[45] Dec. 28, 1976

[54] NETTING

[76] Inventor: Geoffrey William Dilbey, Orchard Cottage, 6 Elwell, Crock Lane, Bridport, Dorset, England

[22] Filed: Mar. 11, 1976

[21] Appl. No.: 666,053

Related U.S. Application Data

[63] Continuation-in-part of Ser. No. 477,756, June 10, 1974, abandoned.

[52] U.S. Cl. ..... 428/255; 87/12; 156/148; 156/252; 264/DIG. 81; 428/257; 428/265

[51] Int. Cl.[2] ..... B66C 1/12

[58] Field of Search ..... 28/72 R, 16; 289/18; 87/12; 156/167, 178, 179, 181, 148, 252; 264/DIG. 81; 428/224, 225, 107, 108, 112, 919, 229, 245, 247, 252, 255, 265, 257

[56] References Cited

UNITED STATES PATENTS

| | | | |
|---|---|---|---|
| 2,402,709 | 6/1946 | Swasey | 28/72 R |
| 2,575,666 | 11/1951 | Knudson | 428/247 |
| 2,600,395 | 6/1952 | Domoj et al. | 28/72 R |
| 2,686,348 | 8/1954 | Goldsmith | 428/255 |
| 2,825,168 | 3/1958 | Ekman | 428/247 |
| 3,252,676 | 5/1966 | Frieder | 139/DIG. 1 |
| 3,575,777 | 4/1971 | Allport | 87/12 |

FOREIGN PATENTS OR APPLICATIONS

| | | |
|---|---|---|
| 489,200 | 7/1938 | United Kingdom |
| 303,111 | 2/1930 | United Kingdom |

*Primary Examiner*—James J. Bell
*Attorney, Agent, or Firm*—Shoemaker and Mattare, Ltd.

[57] ABSTRACT

A method of making a net using at least one strand, characterized in that strand portions are joined at at least one intersection by threading each of two strand portions through a hole in the other of them. A net comprising at least one strand, characterized in that at at least the majority of netting strand intersections remote from the edge of the net, there are at least two intersecting netting strand portions and each of such two-strand portions including a hole through which the other of them passes.

26 Claims, 6 Drawing Figures

NETTING

Cross-Reference to Related Applications

Figure 1:
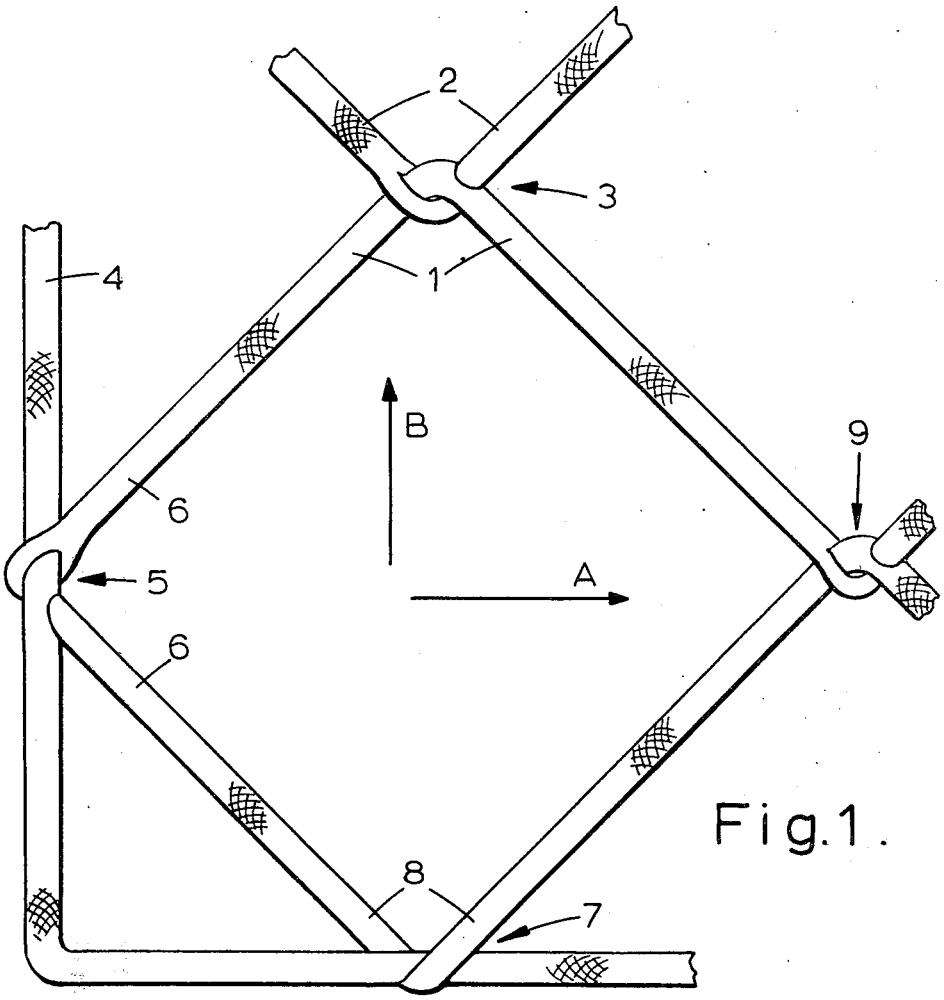

This is a continuation-in-part of application Ser. No. 477,756, filed June 10, 1974, now abandoned.

BACKGROUND OF THE INVENTION

This invention relates to a method of making a net comprising at least one strand. The invention also relates to such a net. More specifically, the invention relates to a method of making a net comprising a plurality of strands of braided or plaited synthetic fibres, and to a net made by such a method.

Hitherto, nets have usually been formed by knotting the intersections between the netting strand portions. Such knotted nets entail inherent weakness at the knots.

In cases when the netting strand is of a synthetic plastics material, it is also known to form the intersections by welding. Welding of synthetic plastics netting strand portions often leads to weakness at the joints and must be performed with great care.

In order to overcome these disadvantages it has been suggested to form an intersection between two portions of the length of the netting strand by passing one such length portion through a hole formed in the other of them. Nets made in this way have the characteristic feature that their intersections can slip, thus leading to local enlargement of the mesh, unless special precautions are taken. This is a serious drawback in some fields of use. This suggestion has been made especially in the case of nets made from webbing, and one special precaution is often stitching the intersecting strand portions together.

The present invention has as its broad object to provide netting which is neither knotted nor welded at the intersections of strand portions. Furthermore, the intersections are not stitched. Thus, the present invention has as its broad object to provide netting which is neither knotted nor welded at the intersections of strand length portions and in which such intersections can constitute secure non-slip junctions.

As broadly defined, the present invention resides in a method of making a net using at least one strand, characterised in that strand portions are formed at at least one intersection by threading each of two strand portions through a hole in the other of them.

In other words, one form of the present invention provides a method of making a net using a plurality of intersecting strands of braided or plaited fibres which can by synthetic, wherein at at least one intersection there are two said strands which are joined together by providing a hole through the body of each of them, and threading a first one of said strands as a body through the hole in the second of said strands, arranging said strands so that the hole through said second strand is spaced apart from the hole in the first strand, angling each of said strands back on itself, threading said second strand as a body through the hole through said first strand, and drawing said strands together by pulling on said strands so that said strands contact each other in the area between said holes to form a secure non-slip junction between said two strands.

Therefore, as broadly defined, the present invention resides in a method of making a net using at least one strand, characterised in that strand length portions are joined at at least one intersection by threading the body of each of two strand length portions through a hole in the other of them.

Making a netting strand intersection in this way is simple and convenient. Such an intersection can be considerably stronger in certain directions than a knotted or welded net. Often, in such knotted or welded nets, the strands are of the same breaking strength. Furthermore, in a knotted net an amount of the netting strand or strands is used up to form the knots, so that by making use of the present invention, a reduction in the length of strand used results. A net intersection made in this way can constitute a secure non-slip junction.

A principal field of use of nets made in accordance with this invention lies in the field of aircargo nets, and it will be appreciated that weight is a particularly important feature in this field. In fact in certain knotted nets which would be of suitable strength for use in air transport, as much as 30% or even 65% of the weight of the net is taken up by the netting strand in the knots. By making use of the present invention, it is possible to reduce the amount of material actually involved in forming the intersections to less than 10% of the weight of the net.

A further important advantage follows from the above. Because of the bulk of material involved in forming knots, these knots project outwardly from any load held by the net, and the knots are thus apt to be abraded easily thus greatly shortening the useful life of a knotted net. This is not the case with a net made in accordance with the present invention to anything like the same extent, particularly when each intersection is formed in the specified "interthreaded" manner, as is preferred.

A said netting strand may be constituted by a strap which can be woven or not, or by twisted or hawser-laid cord.

Preferably, however, the or each said netting strand is braided or plaited cord. Braided or plaited cord is stronger weight for weight than hawser-laid cord, and enables a non-slip intersection to be made.

After completion of the net weaving process, the net may be impregnated with a binding agent to cause the synthetic fibres of each strand to cohere. This promotes the non-slip quality of the intersections, and has the further advantage of reducing abrasion of the strands of the net in use.

In certain embodiments of the invention, the netting strand is pre-formed with a plurality of holes therethrough in places appropriate for forming intersections in a net to be made therefrom, but in the most preferred embodiments of the invention, holes are made in the netting strand during the net making process. In this way, lengths of the same strand could be used to make nets of various differing mesh dimensions. Such holes could be made by hand, for example using a marling spike. Thus, in certain embodiments of the invention, the netting strand is preformed with a plurality of holes through the body thereof.

The invention also relates to a net, comprising at least one strand, and is characterised in that at at least the majority of strand intersections remote from the edge of the net, there are at least two intersecting netting strand portions and each of such two strand portions includes a hole through which the other of them passes.

Stated another way, the invention also relates to a net, comprising at least one strand, and is characterised in that at at least the majority of strand intersections remote from the edge of the net, there are at least two intersecting strand length portions and each of such strand length portions includes a hole through which the body of the other of them passes.

In preferred embodiments of net according to the invention, there is a border cord which extends around at least a part of the periphery of the net, and at at least some of the junctions between netting strand portions and such border cord, the border cord passes through a hole in a netting strand portion and the netting strand passes through a hole in the border cord.

It is noted that the netting strand portion and the border cord portion passing through the holes, each do so as a body.

In many cases it is not always necessary for all the strand-border junctions to be formed in this way; for example, the strand can simply be looped around the border cord. Nonetheless, a more secure junction is afforded when strand portions and the border cord pass through one another as described.

Preferably the or a said strand is of braided or plaited cord, and in the most preferred embodiments is formed from synthetic fibres, for example nylon.

In one net form, the strands pass from one side of the net to the other in unbroken zig-zag manner. This greatly increases the strength of the net in that side to side direction.

A net using the intersection embodying the present invention is formed in a one-piece cruciform shape with the cruciform having a center section or central panel section, with a plurality of wing sections, or side flaps, herein referred to as panel portions, or lobes, extending outwardly therefrom. It has been found that such a shape is very convenient for use in restraining loads on cargo pallets during transportation, although the net can be formed to be clipped onto a floor of an aircraft by appropriate attaching means.

Advantageously a tying cord is attached at at least one corner of said cruciform shape whereby when such net is placed over a rectangular load, each said tying cord can be interlaced through the borders of adjacent lobes of the net to close the net down that corner of the load.

As used herein, a re-entrant angle is a corner between adjacent lobes at the point of intersection between the lobes and the central panel section, and the tying cord can be attached to the net at one, or a plurality of, the net re-entrant angles.

Figure 2:
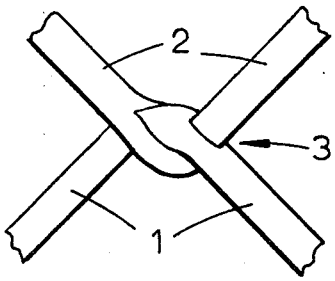
Figure 3:
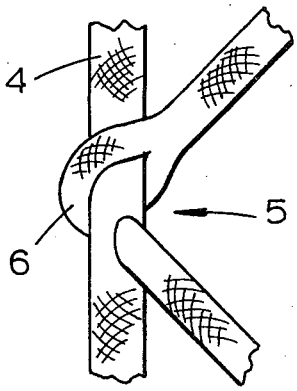
Figure 4:
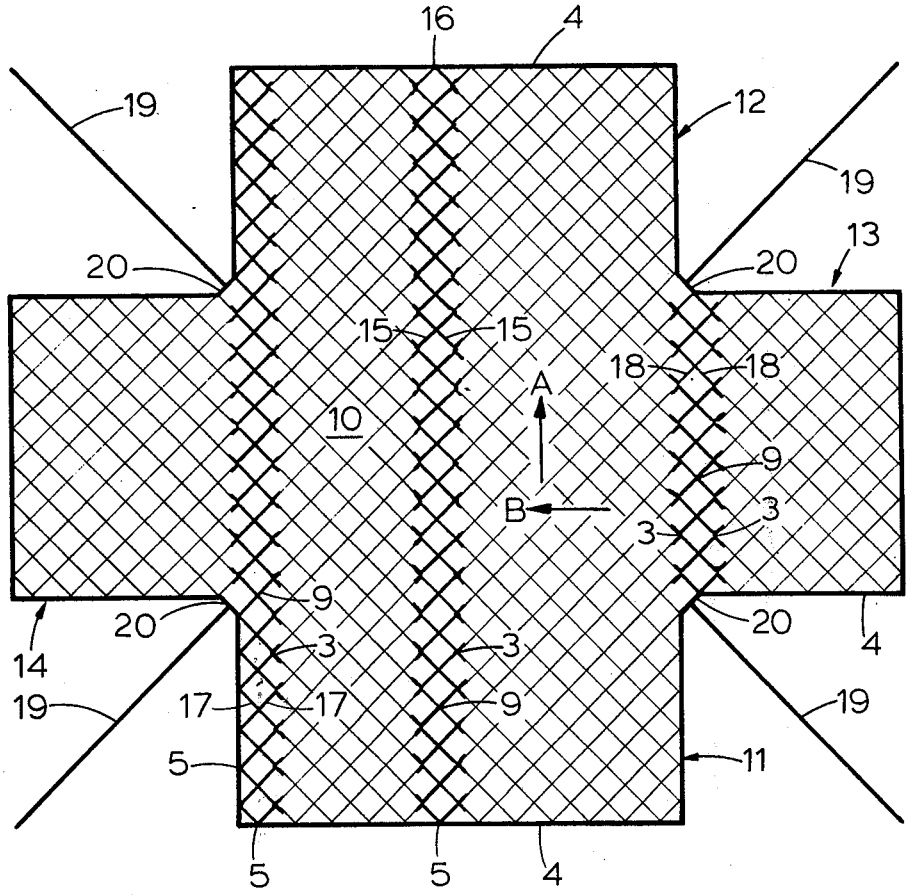
Figure 5:
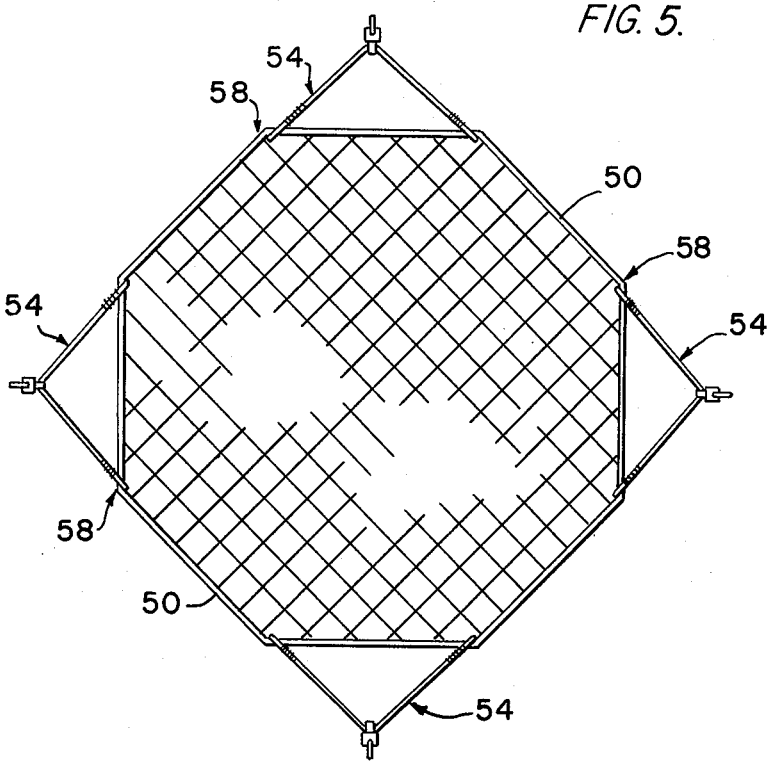
Figure 6:
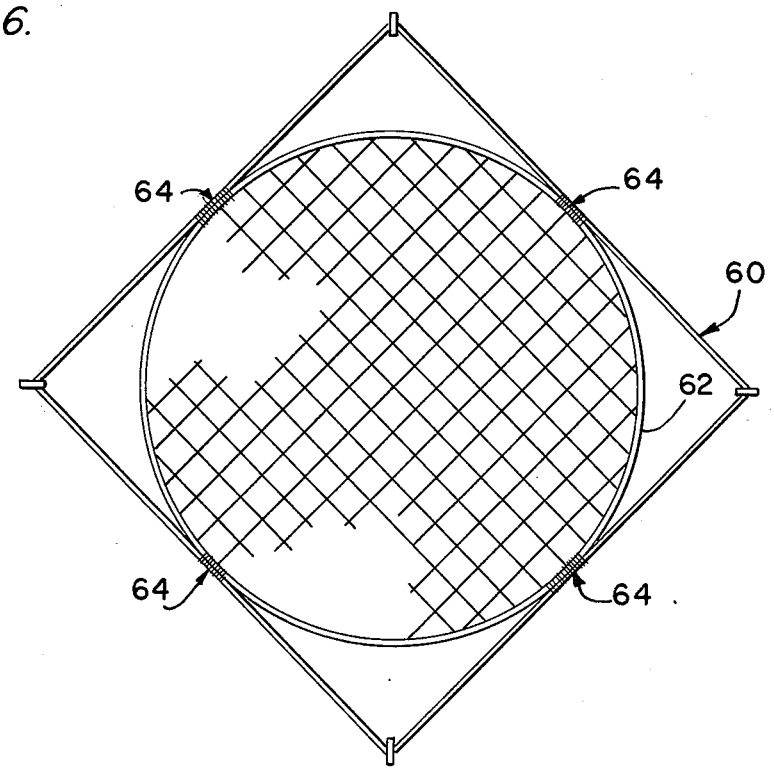

A particularly preferred embodiment of the invention will now be described by way of example with reference to the accompanying drawings in which:

FIG. 1 is a view of a corner section of a piece of netting in accordance with the invention, FIG. 2 is a detail view of the intersection of two netting strand portions at a place remote from the edge of the net, FIG. 3 is a detail view of the intersection of a netting strand portion and a net border cord, FIG. 4 is a general view of an embodiment of net made in cruciform shape, FIG. 5 is a general plan view of an embodiment of a net made in polygonal shape, and FIG. 6 is a general plan view of an embodiment of a net made in a generally circular shape.

In FIG. 1, the netting strand is constituted by braided or plaited nylon cord. The intersection between two netting cord portions 1, 2 is generally indicated at 3 and is more clearly shown in FIG. 2. It will be seen that each cord portion 1, 2 is formed with a through hole, and that the first cord portion 1 passes through the hole in the other cord portion 2, while that other cord portion 2 passes through the hole in the first cord portion 1.

Thus, as shown in the figures, the cord portions each pass as a body through the holes in the cords, and are angled back on themselves to form a secure non-slip junction at which the respective strand portions are in contact between said holes. Thus, as shown in FIG. 1, the cords are doubled back on themselves to form the intersection and can contact each other in the space between the holes.

The holes in the cord portions can conveniently be made by hand using a marline spike during the net making process, that is, as each intersection is formed, and the resulting intersection 3 is a secure non-slip junction.

The holes can be conveniently made after pulling on the strands to draw the respective holes into a position adjacent each other.

Thus, it is seen in FIG. 1 that in a net comprising at least one strand at at least the majority of netting strand intersections, located inwardly of the edge of the net, such as intersection 3, the intersections are each formed by first and second intersecting netting strand length portions, 1 and 2 respectively each including a hole through the body thereof with the holes being spaced apart. Each strand length portion passes as a body through the hole in the other strand length portion and is angled back on itself to form a lead-in section leading into the intersection and a lead-out section out of the intersection. As shown in FIG. 1, the intersecting strand portions are arranged at the intersection so that the lead-in section of strand 1 is generally parallel to the lead-out section of strand 3, and the lead-out section of strand 1 is generally parallel to the lead-in section of strand 3. Also, as seen in FIG. 1, the net can be made using a plurality of intersecting strands wherein at at least one intersection there are two said strands which are joined together by providing a hole through the body of each of them, and threading a first one of said strands as a body through the hole in the second of said strands, arranging said strands so that the hole through said second strand is spaced apart from the hole in said first strand, angling each of said strands back on itself, threading said second strand as a body through the hole through said first strand, and drawing said strands together until said spaced apart holes are located immediately adjacent each other and said strands contact each other in the area between said holes to form a secure non-slip junction between said two strands.

A net formed in this way is also considerably stronger in certain directions than a knotted net made of the same cord.

It has been found that when a knotted net is tensioned, the breaking strain of the net is substantially independent of the relative directions of the tensile stress and the strands. Thus, supposing that FIG. 1 showed a knotted net, the breaking strength of a knotted net in the directions of the arrows A and B would be substantially the same. Knotting a net has been found to reduce its breaking strength to a figure approaching 50% of the integrated breaking strengths of its individual strands, even where such strands run the full width of the net.

This is not the case in a net according to the present invention. In the net actually shown in FIG. 1, strand portions run the full width of the net in the direction of the arrow A, and in this direction, the breaking strength of the net can be as high as 95% of the integrated breaking strengths of the strand or strands from which it is made. In the direction of the arrow B however, because there is no continuous strand portion running all the way across the net, the breaking strength of the net may be as low as 45% of the integrated breaking strengths of the strand or strands. Even though this figure is lower than that in the corresponding direction for a knotted but otherwise similar net, this is often of little or no importance in practice, since it is rare that a net will in use be subjected to tension equally in all directions, and it is therefore usually possible to orient a net according to the invention so as to take advantage of its greatly increased breaking strength in the direction in which the strand or strands run.

One application for netting using the intersections of this invention is in the field of air-cargo.

In this field of use, it is necessary to satisfy certain criteria which require a very high strength in the fore aft direction to the loaded aircraft because most of the forces acting to disturb the load are in that direction. These criteria allow a lower strength in the side-to-side direction of the aircraft. Furthermore, the strands may run the full length of the net in a zig-zag manner in the general direction of the arrow A.

The net shown in FIG. 1 includes a border cord 4 extending around its periphery and this makes a number of intersections such as 5 with portions such as 6 of the netting cord. This intersection 5 is shown in greater detail in FIG. 3, and it will be noted that the border cord 4 and netting cord portion 6 each pass through a hole in the other.

In the case of the intersection generally designated 7 in FIG. 1, the netting cord portion 8 is simply looped around the border cord 4.

An intersection 9 (FIG. 1) between two portions of the same netting strand is formed in the same way as the intersection 3.

Nets according to the invention are especially suitable for use as cargo nets to anchor loads onto pallets. Nets intended for such use may be made cruciform in shape with a central panel area equal to the size of the pallet in conjunction with which it is desired to use the net, and four rectangular panel portions or lobes projecting therefrom for a distance equal to the maximum height to which the pallet is to be loaded. When intended for use in this way, it is especially suitable to make a net according to the invention from a coreless braided or plaited nylon cord having a breaking strength of the order of 2,400 to 4,000 lbs.

It is also noted that the central panel area can be approximately equal to the size of the pallet in conjunction with which it is desired to use the net.

Such a cruciform net is shown in FIG. 4 and may be made of a size suitable for restraining loads on an aircraft cargo pallet measuring for example 125 inches by 88 inches. To this end, the net has a central panel 10 measuring 121½ inches by 84½ inches, and has integral lobes 11, 12 projecting from its long sides and integral lobes 13, 14 projecting from its short edges. Each lobe may project 62 inches from the central panel 10. Of course the net may be made in different sizes. A border cord 4 extends around the net of a material which is generally stronger than the inner cords for receiving attachment means which attach the net to a pallet. The additional strength of the border cord enables that cord to accommodate the loading forces applied thereto by the load on the pallet. A single strand 15 shown in heavy lines leads from the centre of the border of the lobe 11 in zig-zag manner in the direction of arrow A (compare FIG. 1) across the full width of the net to the centre of the border of the opposite lobe 12. The centre of this strand 15 is joined at an intersection 5 (compare FIG. 3) with the border cord 4 along the edge of the lobe 11, and leads across the net, making intersections such as 3 with adjacent strands, and making intersections such as 9 with other portions of itself. At the border of the opposite lobe 12, the strand is spliced into itself or into the border cord 4 as represented at 16.

A second representative strand 17 is shown leading across the net in the same direction. This strand 17 is similarly joined by its centre to the border cord at the edge of the lobe 11, but as it crosses the net, this strand 17, in addition to making intersections such as 3 with adjacent strands and intersections such as 9 with other portions of itself, also makes intersections such as 5 with the border cord running up the side of the lobe 11.

A third representative strand 18 is also shown, and this strand extends, again in zig-zag manner, again in the direction of arrow A, across a lobe 13 formed on a shorter side of the central panel 10.

It is also possible to form a net having a central panel with a single strand passing from one side thereof to the other side thereof in an unbroken zig-zag manner, then attaching, by suitable attaching means, a plurality of wing sections, or lobes to that central panel section to form the cruciform shape shown in FIG. 4. Each, or at least one, of the wing sections, or lobes, can also have at least one strand which passes from one side thereof to the other side thereof in an unbroken zig-zag manner.

Tying cords 19 are attached to the border cord 4 at the corners 20 of the central panel 10 of the net, that is, at the re-entrant angles of the cruciform shape. By interlacing the tying cord 19 at each corner 20 of the central planel 10 with the border cord 4 of the two sides of the lobes leaving that corner, after the net has been placed over a load on a cargo pallet. it is possible to ensure that the net is closed down the corners of the load.

A further net form using the intersections of the present invention is shown in FIG. 5 to be octagonal in shape. A border cord 50 surrounds the net at the outer edge thereof with the strands connected thereto in a manner similar to that discussed above. Lifting straps 54 are suitably attached to the net, preferably at the border cord adjacent corners 58 of the net. The lifting straps are attached by known means to the border cord. Of course, other polygonal shapes can be used, as can a generally circular shaped net, such as that shown in FIG. 6. Suitable lifting straps 60 can also be attached to the net border cord 62, as indicated as 64, which is merely a suggestion of how the lifting straps can be attached to the net and is not intended to be limiting.

The net shown in FIG. 5 does not require a pallet and can therefore be attached to a helicopter or other such transportation vehicle. Thus, loads which cannot normally be transported inside the helicopter due to space problems, can easily be transported using the net shown in FIG. 5 as an underslung cargo net.

In view of the continuous strain which would be imposed on an underslung cargo net in use, it is suitable to make such a net of stronger material than a cargo pallet restraint net. A said underslung cargo net may for example be made from coreless, braided, synthetic cord having a breaking strength of the order of 7000 lbs, though the precise cord strength chosen would of course depend on the loads which it was intended to carry.

Such an underslung cargo net using the strand intersections of the present invention has at least two advantages over known nets. The strength of the net in a direction along the longitudinal dimension of the strands is greatly increased over that of known nets, that is up to 95% of the total cord strength. It is here noted, that the net may rotate in use, but the cargo can be loaded in a manner such that expected heavy loading will be directed lengthwise of the strands. A further advantage of an underslung net using the intersections of the present invention results because there are no protrusions which may abrade thus weakening the net. Thus, if the net is dragged along the ground, or other surface, a net using the intersections of the present invention will not abrade as quickly as nets using knotted intersections. Thus, the FIG. 5 net has advantages similar to those discussed above, to wit: light weight; strength, and the like, as compared to nets using knotted intersections.

It is also noted that all of the nets disclosed herein can be attached to a pallet, or the like, by suitable attaching means, such as buckles, snaps, or the like. These attaching means can also be used to adjust the size of the net according to the size of the cargo, or other load by folding the net upon itself and attaching the attaching means to maintain the net folded against the cargo.

A further use for such attaching means is to close down the corners of a cruciform net when this has been placed on a loaded pallet. In this way it is possible to dispense with the tying cords 19 shown in FIG. 4.

A said cargo pallet restraint net should be constructed in a manner such that when fitted to a pallet loaded on an aircraft the direction A of greater breaking strength of the net lies in the fore-aft direction of the aircraft. The orientation of a pallet in an aircraft hold will clearly be governed by the relative dimensions of the pallet and the aircraft hold. Thus considering the pallet size hereinbefore specified, 125 inches by 88 inches, it is normal practice to load pallets into a Boeing 707 in a single column with the pallets lying transversely across the aircraft. For this purpose therefore, the continuous strands of the net would run across in zig zag manner in a direction generally parallel to the shorter edges of the centre panel of the nets, that is, as shown by arrow A in FIG. 4. The cargo hold of a Boeing 747 on the other hand, is somewhat wider, and it is usual to load such an aircraft with a double column of pallets whose long sides lie parallel to the fore-aft direction of the aircraft. Accordingly, when nets are intended for use in this aircraft, the continuous strands of the net would run across in zig-zag manner in a direction generally parallel to the longer edges of the centre panel of the net.

It is suitable to use polyesters, such as Terylene (Trademark), as well as other suitable synthetic fibres, such as nylon, or metallic fibres, or the like. The net can be made by weaving.

After making a net with intersection formed in accordance with the present invention, it is preferable to inpregnate the net with a binding agent to promote coherence and abrasion resistance of the strands. This may be done by steeping the net in a water based emulsion of polyvinyl chloride and subsequently drying it. Latex is also a very suitable binding agent.

The number of netting strands used may depend on the desired width of the net in the direction of the arrow B, and also on the mesh size selected.

As this invention may be embodied in several forms without departing from the spirit or essential characteristics thereof, the present embodiment is therefore illustrated and not restrictive, since the scope of the invention is defined by the appended claims rather than by the description preceding them, and all changes that fall within the metes and bounds of the claims or that form their functional as well as conjointly cooperative equivalents, and therefore intended to be embraced by those claims.

What is claimed is:

1. In a method of making a net using at least one strand, the improvement wherein portions of the strand length are joined at at least one intersection by providing a hole through the body of each of two strand length portions, and threading the body of a first one of said strand length portions through the hole in the second one of said strand length portions, arranging said strand length portions so that the hole in said second strand length portion is spaced apart from said first strand length portion hole, angling each of said strand length portions back on itself and threading the body of said second strand length portion through the hole in said first strand length portion so that said strand length portions contact each other in the area between said respective spaced apart holes to form a secure non-slip junction between said two strand length portions.

2. Method according to claim 1, wherein at least one strand is braided or plaited cord.

3. The method of claim 1 wherein the net making process includes weaving said net.

4. Method according to claim 3, wherein said holes are made in the netting strand portions during the net weaving process.

5. In a net comprising at least one strand, the improvement wherein at at least the majority of netting strand intersections located inwardly of the edge of the net, there are at least two intersecting netting strand length portions and each of such two strand length portions includes a hole through the body thereof through which the body of the other of them passes. said holes being spaced apart and said strands each being angled back on itself so that each of said strands contacts the other strand in the area between said holes.

6. In a net according to claim 5, further including a border cord having holes defined therein and extending around at least a part of the periphery of the net, and some of said netting strand length portions are joined thereto, wherein at at least some of the junctions between netting strand length portions and such border cord, the border cord passes through a hole in the body of the netting strand length portion and the netting strand length portion passes through one of said holes in the body of the border cord.

7. Net according to claim 5, wherein said at least one strand is a braided or plaited cord.

8. Net according to claim 5, wherein said at least one strand is made from synthetic fibres.

9. In a net comprising at least one strand, the improvement wherein at at least the majority of netting strand intersections located inwardly of the edge of the net, there are at least first and second intersecting netting strand length portions and each of such strand length portions includes a hole through the body thereof through which the body of the other of them passes, said holes being spaced apart and said strand portions each being angled back on itself to form a lead-in section leading into said intersection and a lead-out section leading out of said intersection, said intersecting strand portions being arranged at said intersection so that said first strand lead-in section is essentially parallel to said second strand lead-out section and said first strand lead-out section is generally parallel to said second strand lead-in section.

10. A method of making a net using a plurality of intersecting strands wherein at at least one intersection there are two said strands which are joined together by providing a hole through the body of each of them, and threading a first one of said strands as a body through the hole in the second of said strands, arranging said strands so that the hole through said second strand is spaced apart from the hole in said first strand, angling each of said strands back on itself, threading said second strand as a body through the hole thrugh said first strand, and drawing said strands together until said spaced apart holes are located immediately adjacent each other and said strands contact each other in the area between said holes to form a secure non-slip junction between said two strands.

11. A method according to claim 10, wherein said net has a border and some of said intersections are located inwardly of said border with each intersection of the net which is located inwardly of the border of the net being so formed.

12. A method according to claim 10 wherein said strands are composed of fibres and further including a step of impregnating the net with a binding agent to cause the fibres of each strand to cohere.

13. A method according to claim 10, wherein said holes are made in the strands during the net making process.

14. A net according to claim 5, wherein each intersection of the net which is located inwardly of the edge of the net is so formed.

15. A net according to claim 5, wherein there is a border cord extending around at least a part of the periphery of the net and is intersected by some of said strands and wherein at at least some of the intersections between said border cord and said strands, the border cord and the strands each have holes therethrough, and the border cord passes as a body through the hole in the netting strand and the netting strand passes as a body through the hole in the border cord, the strand and border cord between such holes at a said intersection being in contact.

16. A net according to claim 5, further including a binding agent for causing the fibres of each said strand to cohere.

17. A net according to claim 5, wherein the strands pass from one side of the net to the other in unbroken zig-zag manner.

18. A net according to claim 17, wherein the net is formed in one-piece cruciform shape.

19. A net according to claim 18, wherein said cruciform shaped net includes a central panel section and a plurality of wing sections which intersect said central panel section to form a plurality of re-entrant angles, and further including a tying cord attached to said net at each re-entrant angle of said cruciform shaped net so that when such net is placed over a rectangular load, each tying cord can be interlaced through the borders of adjacent wing sections of the net to close the net down the corners of the load.

20. A net according to claim 5 wherein the net is formed in a cruciform shape having a central panel and a plurality of wing sections.

21. A net according to claim 20, wherein at least one of said strand length portions passes from one side of the central panel to the other side of the central panel in an unbroken zig-zag manner.

22. A net according to claim 20, wherein at least one of said strand length portions passes from one side of one of said wing sections to the other side of said wing section in an unbroken zig-zag manner.

23. A net according to claim 5, wherein the net is generally circular in shape.

24. A net according to claim 5, wherein the net is polygonal in shape.

25. A net comprising:

a border defining cord defining a net border;

a plurality of net strands, said net strands intersecting each other to form a plurality of net strand intersections located inwardly of said net border, a majority of said inwardly located intersections each including a pair of intersecting strand portions with each one of said pair of intersecting strand portions having a hole defined through the body thereof through which the other one of said pair of intersecting strand portions passes as a body, said holes being spaced apart and said strands each being angled back on itself so that each of said strands contacts the other strand in the area between the holes;

each net strand of said intersecting net strands having a medial portion intersecting said border defining cord at a first location so that said each net strand is divided into two portions with each portion extending in a zig-zag manner from said first location across said net to intersect said border cord at a second location, each one of said portions intersecting the other portion and portions of adjacent ones of said plurality of net strands in an alternating manner.

26. The net of claim 25, wherein said portions into which said net strands are divided by the intersection thereof with said border cord are essentially equal in length to each other.

* * * * *